US007086579B2

(12) United States Patent
Matatall et al.

(10) Patent No.: US 7,086,579 B2
(45) Date of Patent: Aug. 8, 2006

(54) BOXES WITH A TISSUE INSERT

(75) Inventors: John Matatall, Londonderry, NH (US); Kenneth B. Schulman, Greenwich, CT (US)

(73) Assignee: Mafcote Industries, Inc., Norwalk, CT (US)

( * ) Notice: Subject to any disclaimer, the term of this patent is extended or adjusted under 35 U.S.C. 154(b) by 0 days.

(21) Appl. No.: 09/795,068

(22) Filed: Feb. 26, 2001

(65) Prior Publication Data

US 2001/0032875 A1 Oct. 25, 2001

Related U.S. Application Data

(60) Provisional application No. 60/211,898, filed on Jun. 16, 2000, provisional application No. 60/185,595, filed on Feb. 28, 2000.

(51) Int. Cl.
*B65O 5/56* (2006.01)

(52) U.S. Cl. ..... 229/164.2; 229/117.07; 229/117.27

(58) Field of Classification Search ..... 229/117.27, 229/164.2, 117.03, 117.07
See application file for complete search history.

(56) References Cited

U.S. PATENT DOCUMENTS 1,443,055 A * 1/1923 Sutherland ..... 229/117.03
2,008,935 A * 7/1935 Stern et al. ..... 229/117.07 X
2,095,910 A * 10/1937 Bergstein ..... 493/91
2,319,371 A * 5/1943 Stonecypher ..... 229/117.07
2,617,579 A * 11/1952 Buttery ..... 229/117.06
2,656,092 A * 10/1953 Ellsworth ..... 229/164
2,755,012 A * 7/1956 Levkoff ..... 229/164.2
2,837,261 A * 6/1958 Stenger ..... 229/192
2,936,101 A 5/1960 Eimer
2,980,310 A * 4/1961 Arneson ..... 229/117.07
3,223,230 A * 12/1965 Bianchi ..... 229/164.2
3,490,581 A * 1/1970 Desmond et al. ..... 229/117.27

(Continued)

FOREIGN PATENT DOCUMENTS

DE 1260954 2/1968

(Continued)

*Primary Examiner*—Tri M Mai
(74) *Attorney, Agent, or Firm*—Ware, Fressola, Van Der Sluys & Adolphson LLP

(57) ABSTRACT

A tissue-lined box is formed from a carton blank having a generally rectangular bottom panel with a width W, the carton blank having integral side walls and end walls connected with the bottom panel at creased fold lines. Four corner panels, one corner panel positioned at each respective corner of the generally rectangular bottom panel as an integral extension of one of the side wall and the end wall and connected to the other of the side wall and end wall to form the box. Fold lines adapt the box for folding to a flat condition and to an erected open position. A tissue insert has at least one layer of tissue paper and is folded to have at least one folded edge, the width T of the tissue insert taken from the folded edge to the opposite edge being greater to the width W of the bottom panel. The tissue insert is placed on the bottom panel with the tissue insert substantially covering the bottom panel and having at least one marginal edge extending beyond the bottom panel and positioned on the adjacent side wall, the marginal portion of the tissue adjacent the side wall being folded at the crease line between the bottom panel and the side wall when the box is folded to its flat condition.

10 Claims, 8 Drawing Sheets

U.S. PATENT DOCUMENTS

| | | | | |
|---|---|---|---|---|
| 4,571,232 | A | 2/1986 | Diehl | |
| 5,023,134 | A * | 6/1991 | Bezigian et al. | 6/91 |
| 5,094,863 | A * | 3/1992 | Vandenburg | 426/115 |
| 5,421,509 | A * | 6/1995 | Thuin et al. | 229/117.07 |
| 5,989,171 | A | 11/1999 | Hirschey et al. | |
| 6,305,600 | B1 * | 10/2001 | Hirschey | 229/164.2 |

FOREIGN PATENT DOCUMENTS

| | | |
|---|---|---|
| EP | 0541440 A1 | 12/1993 |
| FR | 648269 | 12/1928 |
| FR | 1279916 | 11/1961 |
| GB | 2084961 A | 4/1982 |

* cited by examiner

BOXES WITH A TISSUE INSERT

PRIORITY

This application claims priority to U.S. Provisional Application No. 60/185,595 filed Feb. 28, 2000 and to U.S. Provisional Application No. 60/211,898 filed Jun. 16, 2000.

FIELD OF INVENTION

The invention herein relates to boxes with a tissue insert.

BACKGROUND OF THE INVENTION

It is desirable to place a tissue insert in gift boxes provided by retail stores to their customers. This permits the customer purchasing an item as a gift to place the item within a tissue wrapping within the gift box provided by the store. Such boxes are shown in U.S. Pat. No. 4,571,232. Another method of making boxes with tissue inserts is disclosed in U.S. Pat. No. 5,989,171, where tissue inserts are pre-folded to a width more narrow than the bottom of the boxes. This leaves a gap between the tissue and the side wall of an erected box, partially exposing the bottom of the box in an unsightly manner.

Providing a tissue insert in an infold Beers-type box has an additional consideration. An infold Beers-type box has free distal corners of corner panels that tend to drag across the bottom of the box as the box is erected, and nestle on or near the crease fold between the bottom of the box and side wall of the box when the box is erected to assist in maintaining the erected configuration. However, the free infolded distal corners can damage tissue inserted in the box prior to the box being folded flat, particularly if the tissue is at the full or greater width than the bottom of the box.

In Simplex-type boxes, the side and end walls have two thicknesses of paperboard stock when the box is erected. Any insertion of tissue must take into account this structure, which has limited tissue inserts to having a width equal to or less than the width of the carton bottom.

SUMMARY OF INVENTION

Accordingly, it is a principal object of the invention to provide boxes with tissue inserts.

It is an additional object of the invention to provide boxes with tissue inserts releasably held within the boxes.

In carrying out the invention, Simplex and Beers-type cartons are provided with tissue inserts wider than the bottom panel of the box. At least one edge of the tissue inserts are folded over with the box sides which are adapted to accept the tissue inserts.

In an infold Beers-type box, the free distal corners of the corner panels are each provided with a friction foot, and the corner panels are each relieved between the friction foot and the crease joining the corner panel with the adjacent side wall to form the friction foot. The corner panels are glued to adjacent side walls in the known manner of infold Beers-type boxes. As the box is erected, each friction foot drags easily across the bottom of the box, including across a tissue insert therein. When the box is erected, each friction foot engages the box at or near the crease joining the bottom panel with a side wall and assists in maintaining the erected configuration.

When tissue is provided in a width greater than the bottom of the box, each friction foot holds the tissue in place, but releases the tissue readily for wrapping about an item placed in the box. However, the Beers-type box with friction feet is useful with or without a tissue insert.

In another, outfold Beers-type box, the tissue insert is placed on the box blank, the tissue insert having a width greater than the width of the bottom of the box. Corner panels integral with end walls of the box are folded to overlie the tissue in the corners of the box bottom. The side walls are then folded over and secured to the corner panels, and the end walls are folded over the corner panels and side walls. This results in marginal corner portions of the tissue insert being captured between the corner panels and side walls, holding the tissue insert in place but permitting its removal, if desired.

In a Simplex-type box, the side walls are provided in double thickness from the top edge of the side wall to a terminus spaced from the bottom wall to accommodate the tissue insert. One or more marginal edges of the tissue insert may be captured adjacent the terminus, if desired.

The foregoing and other more specific objects and features of the invention will in part be readily understood by those skilled in the art and will in part appear from the following description of the preferred embodiments and the claims, taken together with the drawings.

DRAWINGS

The same reference numerals refer to the same elements throughout the various Figures.

DESCRIPTION OF PREFERRED EMBODIMENTS

Figure 1:
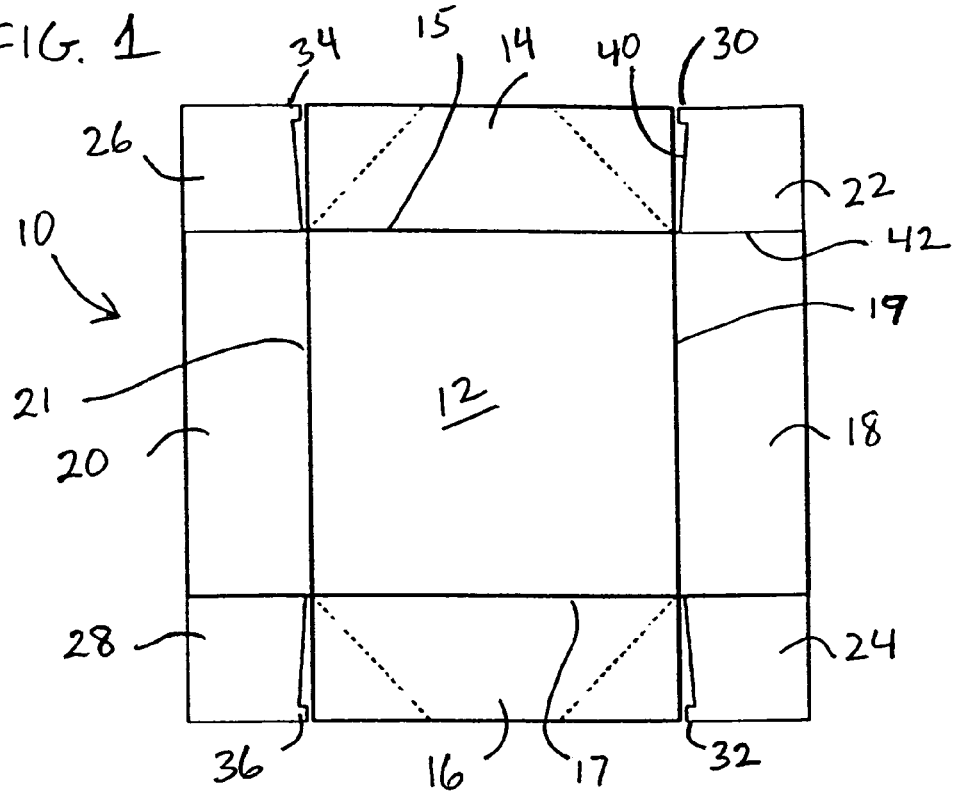
FIG. 1 is a plan view of a box blank according to the invention herein.

With reference to FIG. 1, a box blank 10 of a Beers-type box is illustrated in plan view. It includes a bottom panel 12, side walls 14 and 16, and end walls 18 and 20. Creased fold lines 15, 17, 19, 21 are provided where the bottom panel meets the side and end walls. The end wall 18 has first and second corner panels 22 and 24 extending therefrom, and end wall 20 has corner panels 26 and 28 extending therefrom. The corner panel 22 has a friction foot 30 extending from the free distal corner thereof toward the side wall 14, and the remaining corner panels 24, 26, 28 are respectively provided with friction feet 32, 34, and 36 extending from their distal free corners. The corner panel 22 is relieved between the friction foot 30 and the crease 42 joining the corner panel with the end wall 18. The relief is defined by a relief edge 40 that diverges from the adjacent side wall 14 as it extends toward the friction foot 30. The remaining corner panels 24, 26 and 28 are similarly relieved. Thus, the friction feet 30, 32, 34 and 36 are provided.

Figure 2:
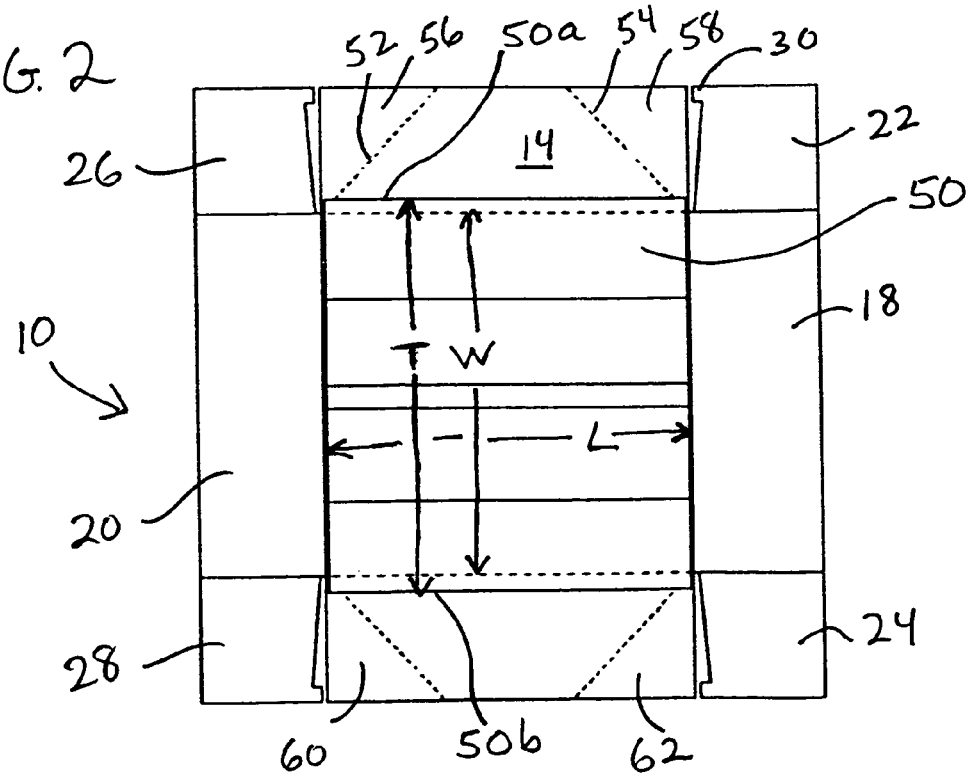
FIG. 2 is a plan view of the box blank of FIG. 1 and a tissue insert according to the invention.

With reference to FIG. 2, a tissue insert 50 is provided with the box blank 10. The tissue insert 50 is folded into several layers and has a width T measured from its first folded side edge 50*a* to its second edge 50*b* that is greater than the width W of the bottom panel 12 of box 10, so that marginal portions of the tissue adjacent side edges 50*a*, 50*b*, the tissue extends onto the side walls 14, 16. The tissue insert may be formed of one or more layers before folding. A continuous strip of tissue is preferably folded and a desired length of folded tissue is cut off to form the tissue insert. It has at least one fold, but may have a plurality of folds. The side edge 50*b* is also at a fold in the embodiment shown. The width T is preferably on the order of ¼–1" greater than the width W of the bottom panel 12, where the width W of the bottom panel 12 is on the order of 6–12 inches.

The tissue insert 50 has a length L corresponding with the length of the base panel 12 and the side walls 14 and 16. However, the tissue insert may be somewhat longer, particularly when used with other styles of box blanks. The length of the bottom panel 12 is generally between about 6 and 18 inches. Other widths and lengths are useful.

Figure 3:
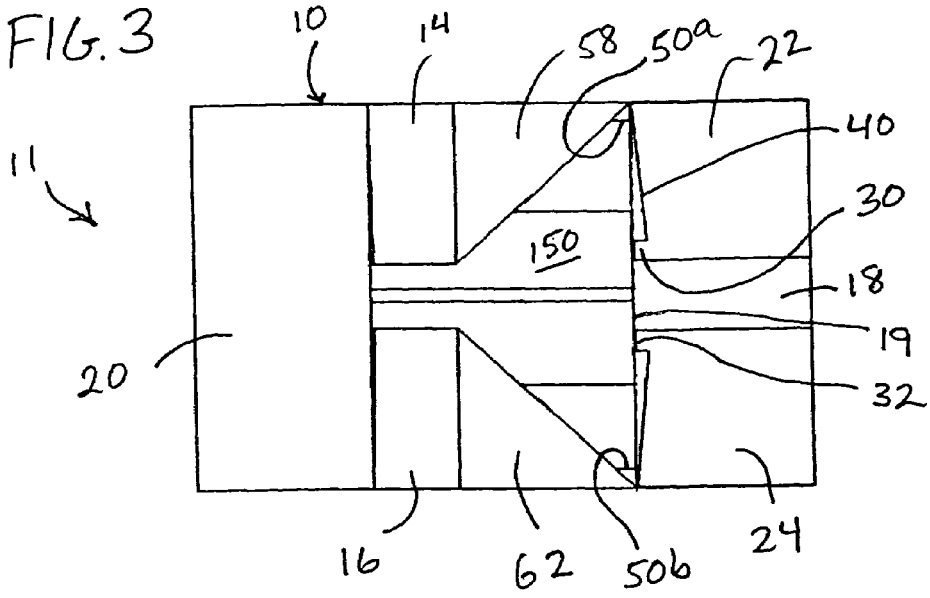
FIG. 3 is a plan view of the box blank and tissue of FIG. 2, partially folded for manufacture into a box according to the invention.

The manufacture of a box 11 from the box blank 10 and tissue insert 50 is illustrated in FIG. 3. It will be noted in FIGS. 1 and 2 that the side wall 14 is provided with diagonal fold lines 52 and 54, defining triangular wall segments 56 and 58. Side wall 16 is similarly provided with fold lines defining triangular wall segments 60 and 62. As shown in FIG. 3, the side walls 14 and 16 are folded inwardly over the bottom panel 12 and tissue insert 50. The marginal portions of the tissue insert 50 adjacent side edges 50*a*, 50*b* extending onto the side walls 14, 16 is also folded over with the sidewalls. The side walls are also folded along the diagonal fold lines to expose the corner segments 58 and 62. The corner panels 22 and 24 of end wall 18 are also shown folded inwardly to lie adjacent the end wall 18. The next step in assembly is to fold the end wall 18 and corner panels 22 and 24 along the crease 19 to overlie the wall segments 58 and 62. Glue is provided on the corner segments 58 and 62 or the corner panels 22, 24 to secure the box 11 together and also to the corresponding corner panels 26, 28 of end wall 20. With reference to FIG. 3, the friction foot 30 of corner panel 22 and the friction foot 32 of corner panel 24 lie adjacent the crease 19 when the box is glued together in its flattened condition. The opposite end wall 20 is shown already folded over and glued in position, and FIG. 4 shows the box 11 in its flattened assembled condition.

Figure 4:
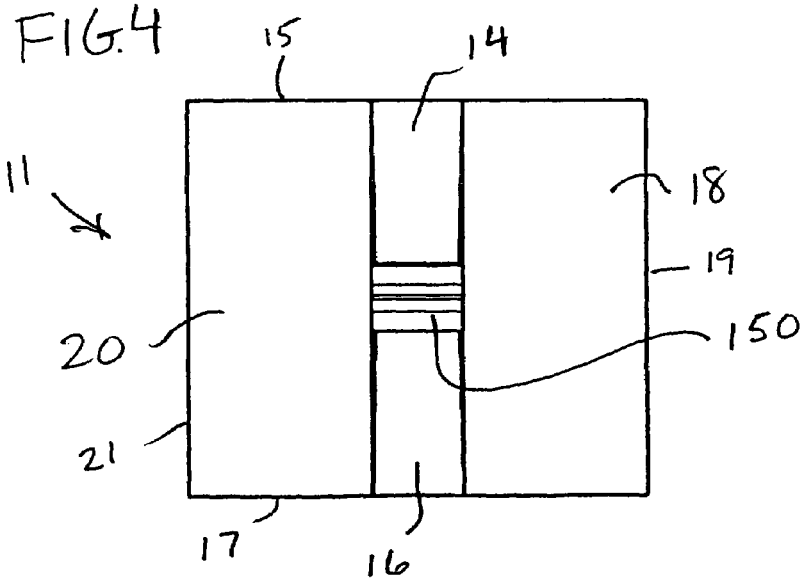
FIG. 4 is a plan view of the box made from the box blank and tissue of FIG. 2, folded flat for storage and shipment.
Figure 5:
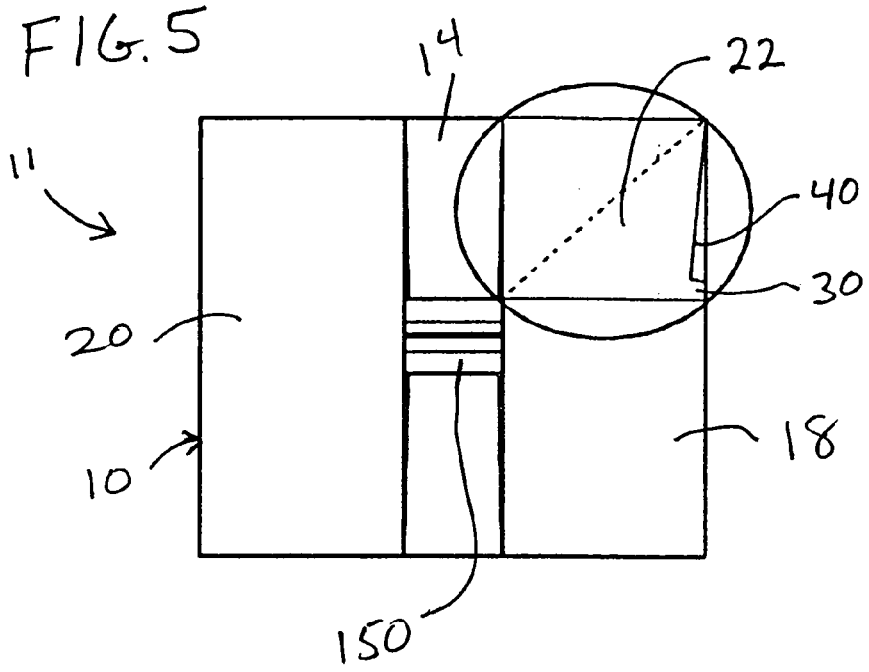
FIG. 5 is a plan view of the folded box of FIG. 4 according to the invention, partially cut away to show a folded corner panel.

With reference to FIG. 5, a portion of the end wall 18 is cut away to expose and illustrate the position of the corner panel 22 when the box 11 is in its assembled condition of FIG. 4. It will be noted in FIG. 5 that the friction foot 30 still lies adjacent the crease 19, but the corner panel 22 is now folded over to lie atop the tissue insert 50.

Figure 6:
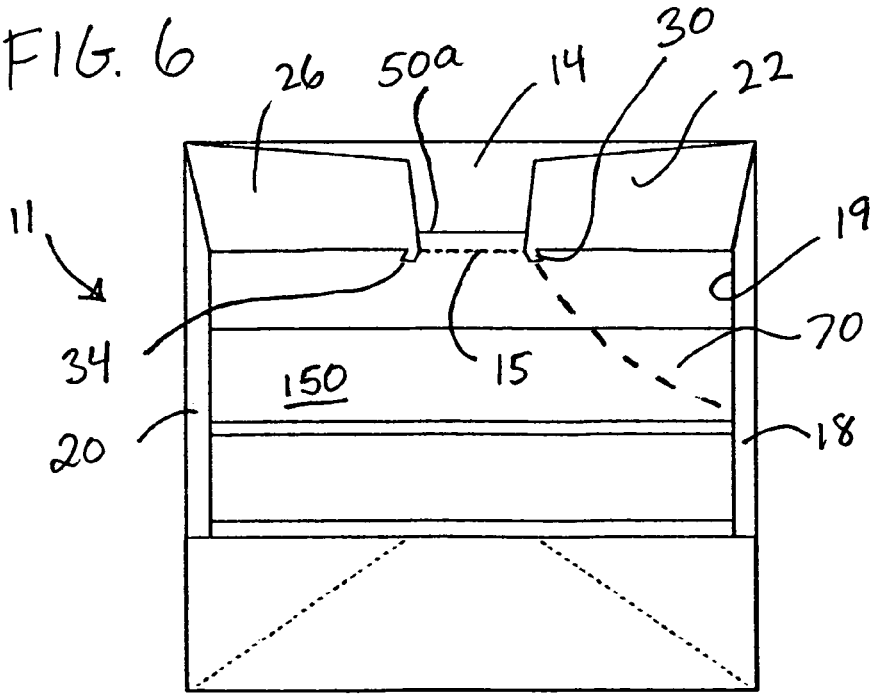
FIG. 6 is a view of the box of FIG. 4 being erected.

The box 11 is shown in its erected position in FIG. 6. As the box is erected, the side wall 14 is folded to a position substantially upright with respect to the bottom panel 12 and the tissue insert 50, and the friction foot 30 drags along the arcuate line dotted line shown at 70, across the tissue insert 50, to nestle adjacent the crease 15 between the side wall 14 and the bottom panel 12. Because the friction foot 30 is relatively small, it drags easily across the tissue insert 50, but nestles against the tissue insert and bottom panel 12 adjacent the crease 15, holding the side wall 14 in its upright position. The friction foot 34 similarly slides across the bottom panel 12 and tissue insert 50 to be situated adjacent the crease 15. The friction feet 30 and 34 maintain the tissue insert 50 in position against the bottom panel 12 of the box, but hold it lightly so that the tissue insert can be released and unfolded if desired for wrapping and placing an item in the box 11.

Figure 7:
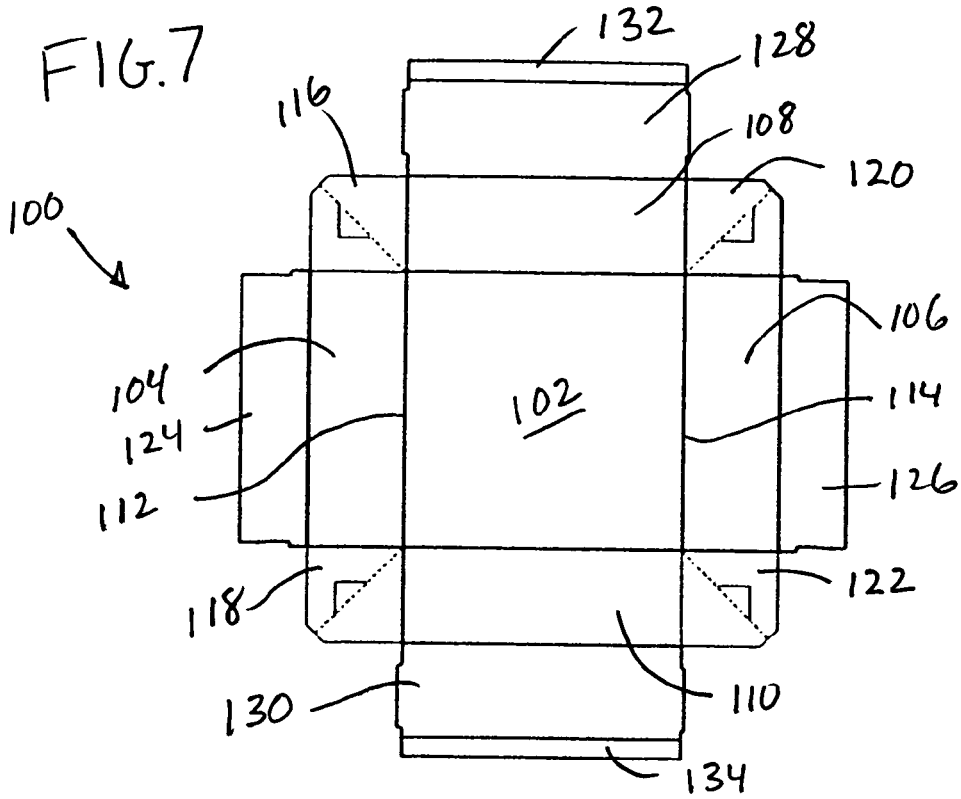
FIG. 7 is a plan view of another box blank.

With reference to FIGS. 7–10, a second box blank 100 and box 101 are illustrated. This is for a Simplex-type box, provided with a tissue insert 150. Referring first to FIG. 7, the box blank 100 is shown having a generally rectangular bottom panel 102 with side walls 104 and 106 and end walls 108 and 110 integrally connected thereto at fold lines or creases. The creased fold lines include a first fold line 112 between the bottom panel 102 and side wall 104, and a second fold line 114 between the side wall 106 and the bottom panel 102. The side walls and end walls are integrally connected by corner panels 116, 118, 120 and 122. These corner panels are diagonally creased.

The side walls 104 and 106 have side wall extensions 124 and 126, respectively, which are folded back on the side walls and glued thereto to provide a double thick side wall for the box. The end walls 108 and 110 have end wall extension flaps 128 and 130, respectively, and the end wall extension flaps have foot panels 132 and 134.

Figure 8:
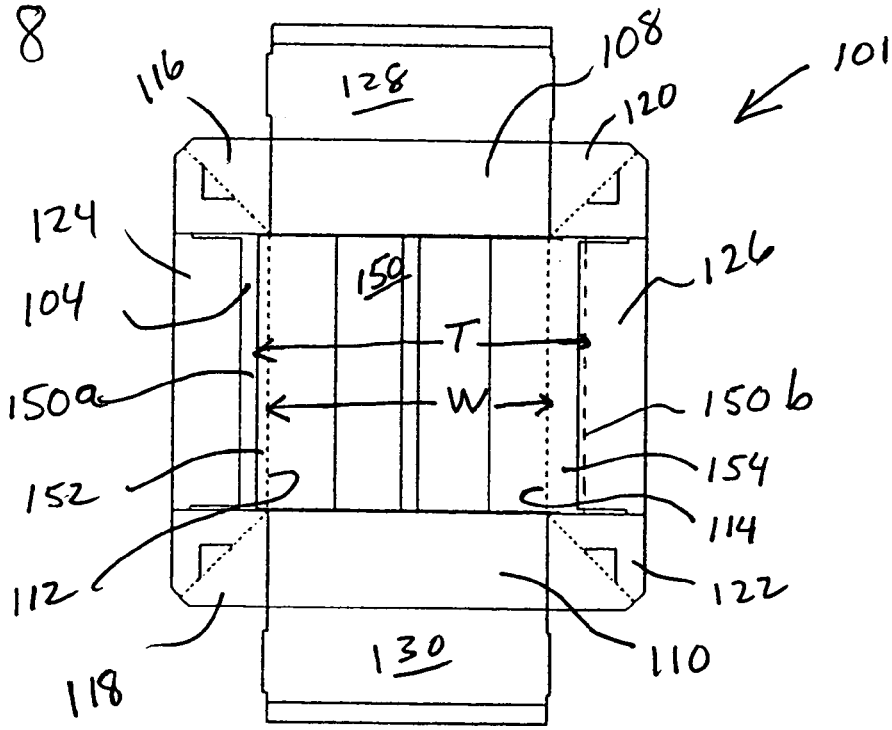
FIG. 8 is a plan view of the box blank of FIG. 7 including a tissue insert according to the invention.

With reference to FIG. 8, the tissue insert 150 is placed on the bottom panel 102. The tissue insert has a width T between its first and second side edges 150*a*, 150*b* which is greater than the width W of the bottom panel 102. Therefore, the tissue insert 150 has marginal edge portions 152 and 154 which overlay the creased fold line 112 and adjacent portion of the side wall 104, and the creased fold line 114 and adjacent portion of the side wall 106. In FIG. 8, the side wall extensions 124 and 126 are shown folded inwardly, and it will be noted that their height is less than the height of the side walls 104 and 106, such that they do not overlay the side panels 124 and 126. Although the side wall extensions are of lesser height than the height side walls, they nevertheless provides a sturdy box.

The width T of the tissue insert is preferably ¼" to 1" greater than the width W of the bottom panel 102. Thus, it will extend up the side walls 104 and 106. It may be sufficiently wide that part of one or both of the marginal edge portions 152 and 154 is captured between the folded over side wall extensions 124, 126 and their respective side walls 104, 106. In the embodiment shown, marginal edge portion 154 is captured. Glue holding the side wall extensions to the side walls is not placed near the terminal edge of the side wall extensions, so that the tissue insert 150 does not become glued within the box 111.

Figure 9:
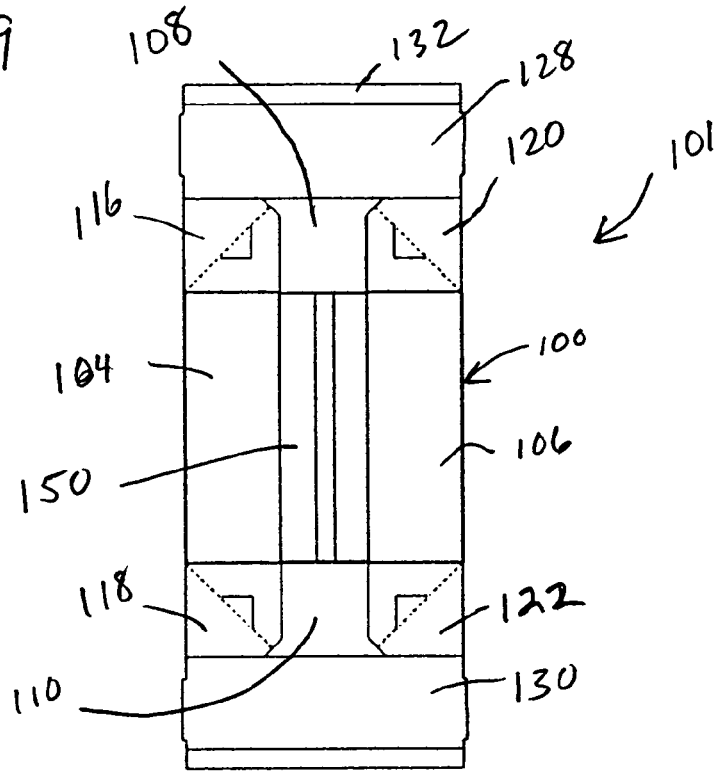
FIG. 9 is a plan view of a box made from the box blank and tissue of FIG. 7, folded flat for storage and shipment.
Figure 10:
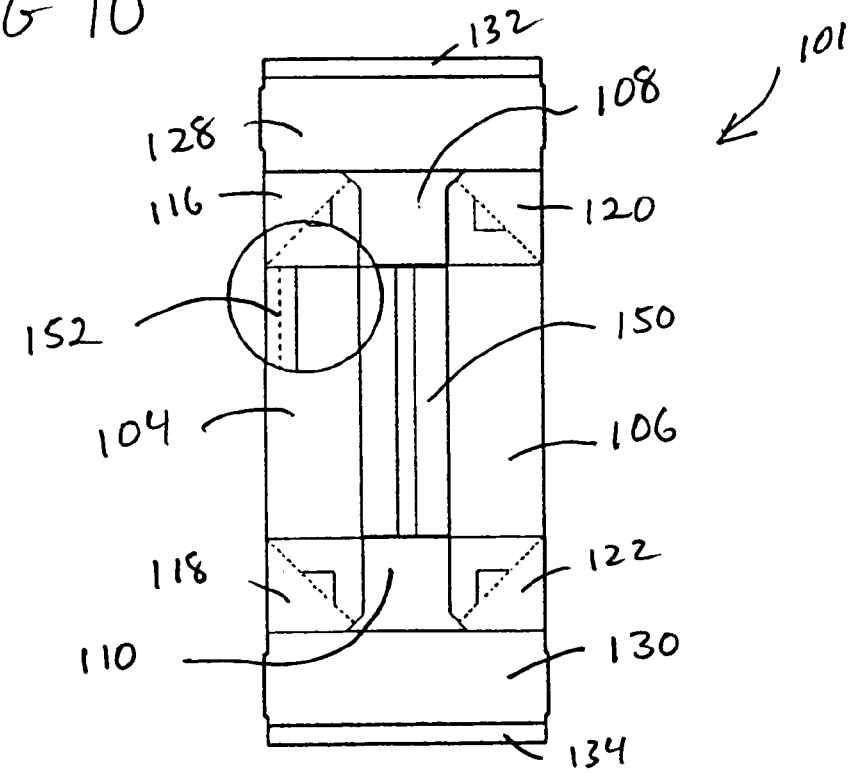
FIG. 10 is a plan view of the folded box of FIG. 9, partially cut away to show a folded corner panel.
Figure 11:
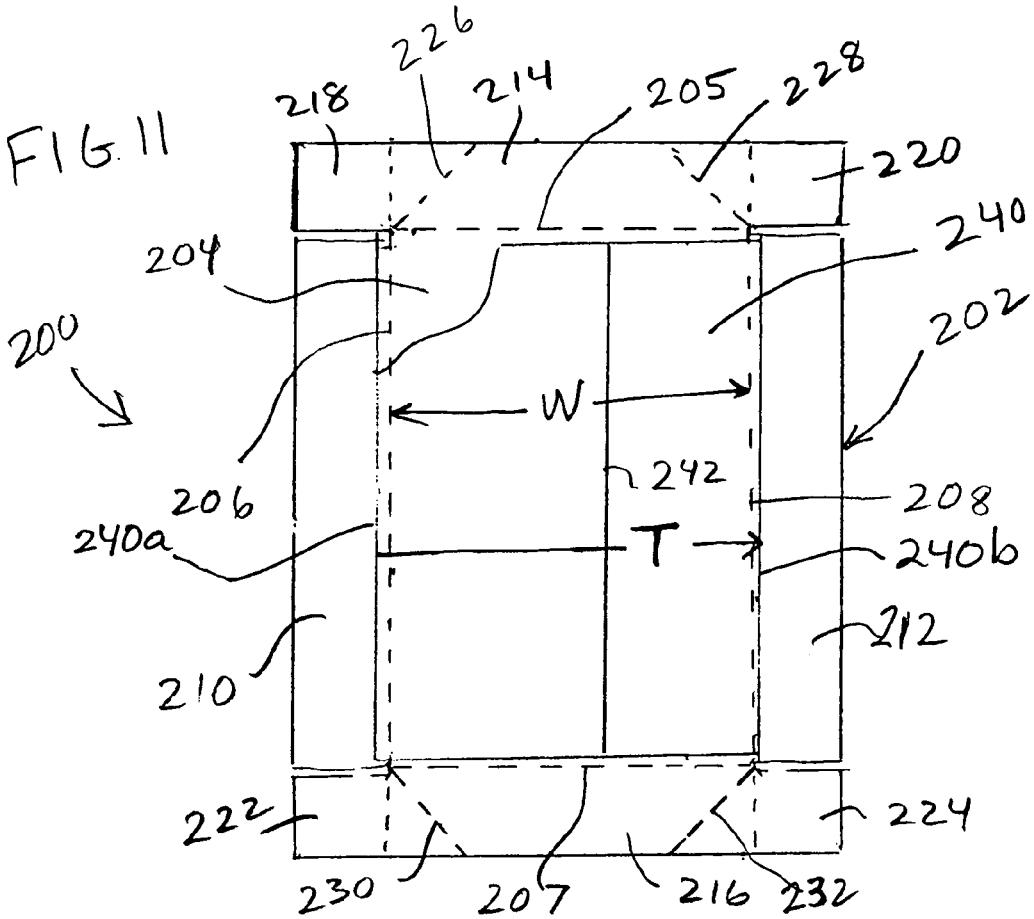
FIG. 11 is a plan view of a box blank for an outfold Beers-type box, having a tissue insert positioned thereon, according to the invention.

Construction of the box 101 is continued by gluing portions of the corner panels 116, 118, 120 and 124 adjacent to the end walls 108 and 110 to those end walls, and the side walls 104 and 106 are folded over to lie against the bottom panel 102. This is shown in FIGS. 9 and 10. In FIG. 10, the overlying side wall 104 is cut away to show that the tissue insert marginal edge portion 152 is folded over at the crease fold line 112, which occurs simultaneously with the folding of the side wall 104. The end walls 108, 110 may also be folded over for storing and transporting box 101. Upon unfolding the box for erection, the end wall extension flaps 128, 130 are folded over and tucked into the interior of the box, held by the feet 132, 134. The tissue is presented fully covering the bottom panel of the box, providing a neat finished appearance.

With reference to FIGS. 11–16, another box blank 202 for an outfold Beers-type box 200 is shown. The box 200 is formed of a box blank 202 having bottom panel 204 defined by peripheral fold lines 205–208. The box blank is provided with side walls 210 and 212 extending from the fold lines 206, 208 respectively, and with end walls 214 and 216 extending from fold lines 205 and 207, respectively. Fold lines, also sometimes referred to as crease lines or creased fold lines, are represented by dotted lines in the FIGS. 11–16. End wall 214 has corner panels 218 and 220 extending therefrom to lie adjacent the ends of the side walls 210 and 212, and end wall 216 has corner panels 222 and 224 also extending to lie adjacent the opposite other ends of side walls 210 and 212. The end wall 214 has diagonal fold lines 226, 228, and end wall 216 has diagonal fold lines 230, 232, which aid in assembling folding and erecting the box 200, as more fully discussed below.

A tissue insert 240 is placed on the box blank 202. The tissue insert 240 may comprise a wide piece of tissue, of several plies if desired, folded over to form three or more layers, with one of the free edges 242 being visible. The width T of the tissue insert 240, taken between the first and second folded side edges 240*a* and 240*b* is preferably greater than the width W of the bottom panel 204 taken between the fold lines 206 and 208. The tissue insert is preferably placed on the bottom panel 204 with the marginal portions respectively adjacent first and second side edges 240*a*, 240*b*, respectively extending over the fold lines 206, 208, to lie on or adjacent the lower portions of side walls 210, 212. The tissue insert 240 is placed on the box blank 202 before it is glued and folded to form box 200.

Figure 12:
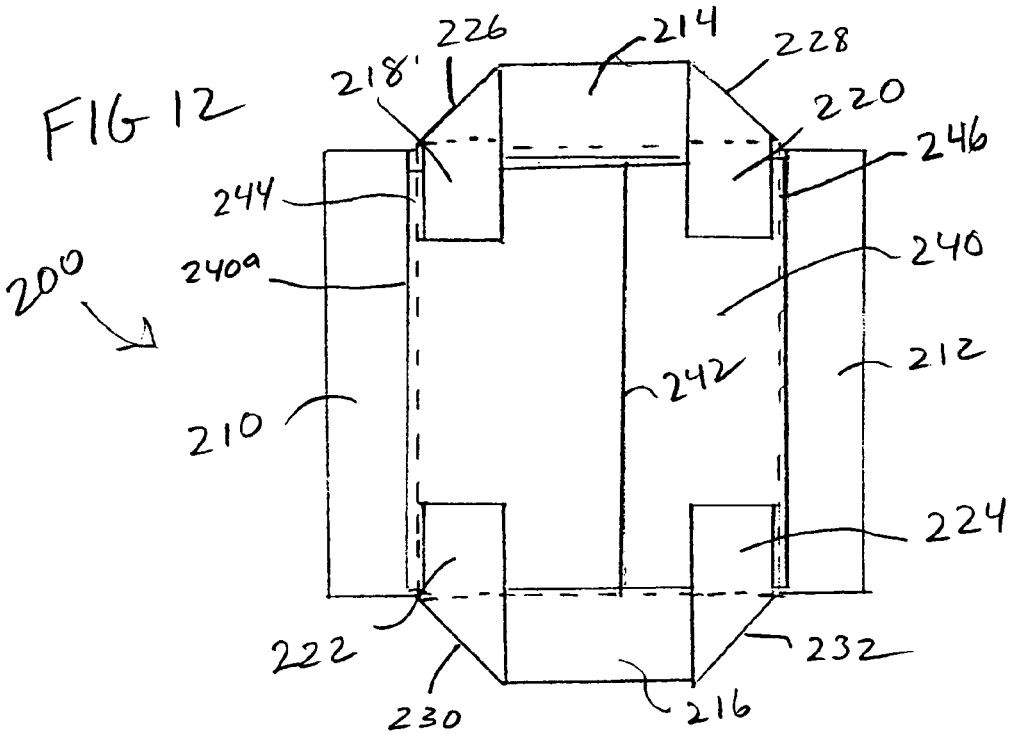
FIG. 12 is a plan view of the box blank and tissue insert of FIG. 11, with the corner panels of the box blank folded.

With reference to FIG. 12, the end wall 214 is folded at the diagonal fold lines 226 and 228, which thus become edges given the same reference number, so that the corner panels 218 and 220 overlie the tissue insert 240. Similarly, the end wall 216 is folded at the diagonal fold lines 230 and 232, so that the corner panels 222 and 224 overlie the tissue insert 240. Because the tissue insert 240 is wider than bottom panel 204, marginal corner portions of the tissue insert 240 adjacent the corner panels extend beyond the corner panels (after they are folded to the position of FIGS. 12) and a short distance up the side walls 210 and 212. In particular, a marginal corner portion 244 extends beyond corner panel 218 and partly along the side wall 210, and marginal corner portion 246 extends beyond the corner panel 220 and part way along the side wall 212.

Figure 13:
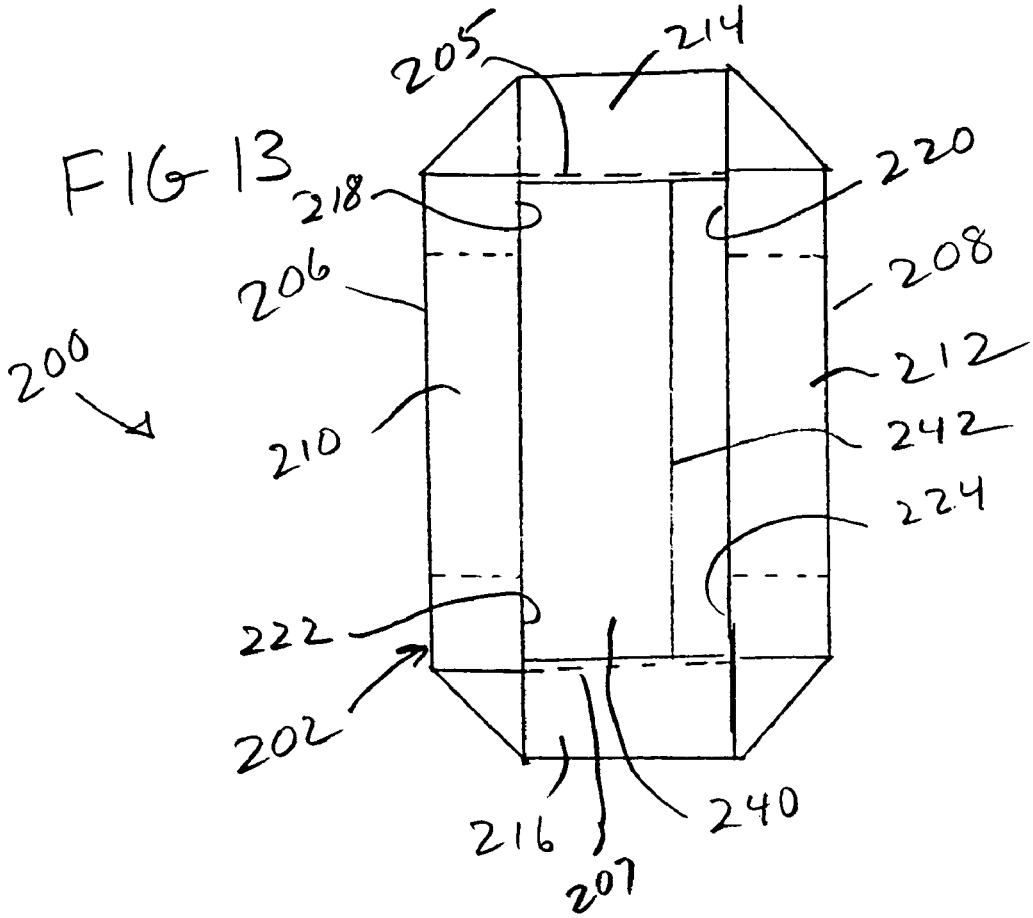
FIG. 13 is a plan view of the box blank and tissue insert of FIG. 11, with the side walls of the box blank folded over and joined to the corner panels.

With reference to FIG. 13, the sequence of assembling box blank 202 into a box 200 is further illustrated, wherein the side wall 210 is folded at the fold line 206, so that the side wall 210 overlies the corner panels 218 and 222, the edges of which are shown in dotted lines. Similarly, the side wall 212 is folded at the crease line 208 to overlie the corner panels 220 and 224, the edges of which are shown by dotted lines. Glue is placed on one of the side wall or corner panel at each of the corners, so that the side walls and corner panels are secured together.

Figure 14:
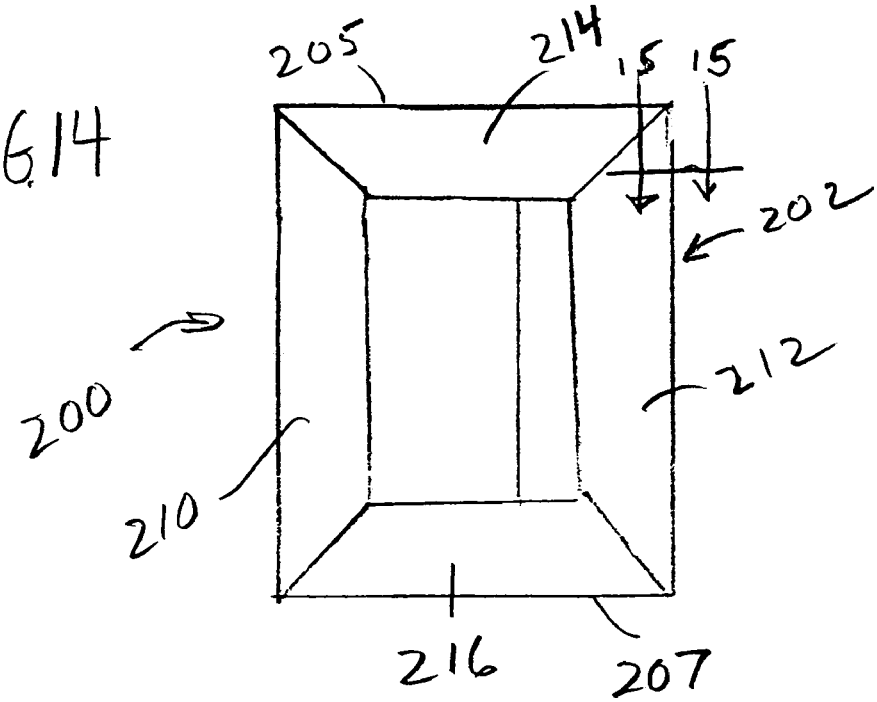
FIG. 14 is a plan view of the box blank and tissue insert of FIG. 11, with the end walls of the box blank folded over the side walls.

With reference to FIG. 14, end walls 214 and 216 are shown folded inwardly at fold lines 205 and 207, thereby providing a box 200 in flattened condition and having the dimensions of the bottom panel 204. This is convenient for storing and shipping the boxes, and for delivering individual boxes to end users. The box 200 is readily erectable by grasping the end walls 214, 216 and folding them upwardly, and by grasping the side walls 210 and 212 and folding them upwardly as well, to provide the box 200 in the open-topped position of FIG. 16. The user will readily appreciate it may be desirable to "overfold" the side walls when erecting the box, to compensate for any set the side walls and end walls take from their flattened condition.

Figure 15:
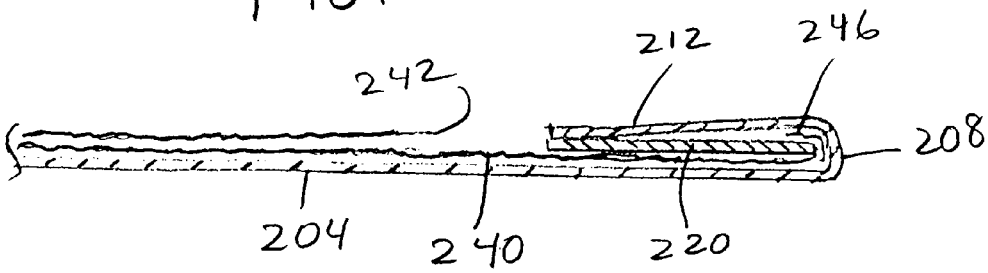
FIG. 15 is a fragmental sectional view of the box blank and tissue insert of FIG. 11 in the configuration of FIG. 14, taken along the lines 15—15 of FIG. 14.
Figure 16:
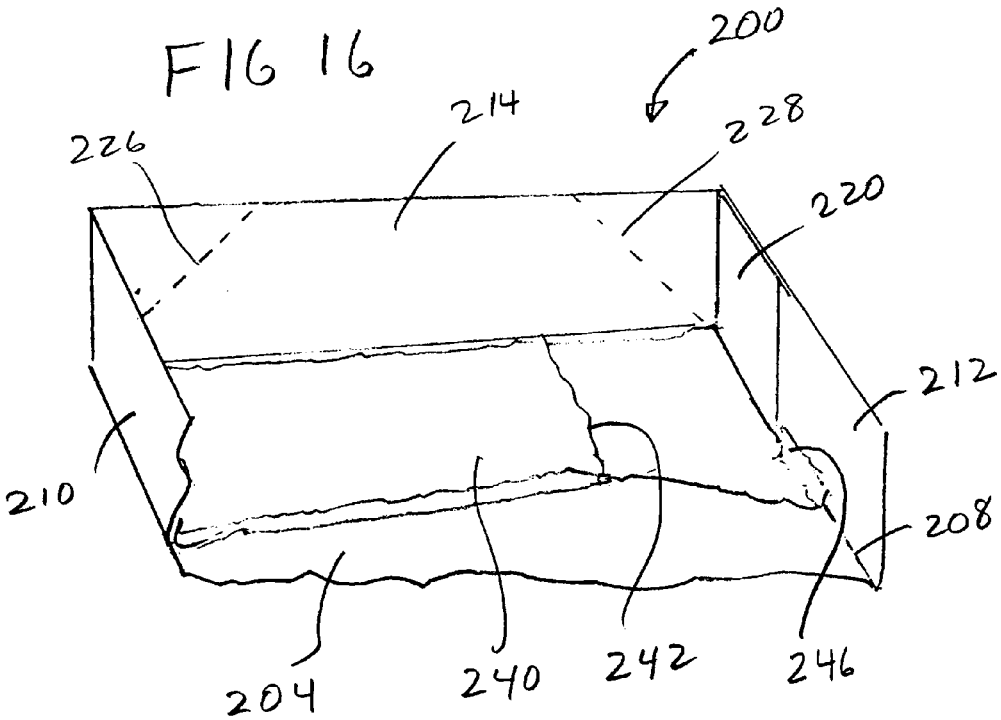
FIG. 16 is a perspective view, partially cutaway of the box blank and tissue insert of FIG. 11 assembled and erected as a box.

The tissue insert 240 is presented in the box 200 and is held at its corners. This is illustrated in FIGS. 15 and 16, wherein the tissue to insert 240 is shown positioned on the bottom panel 204 of the box blank 202 forming box 200. The corner panel 220 extending from end wall 214 overlies a marginal tissue insert 240, as can also be seen in FIG. 12. As side wall 212 is folded over at fold line 208 and secured to the corner panel 220 such as by glue 248, the edge portion 246 of the tissue extending beyond the fold line 208 (exaggerated in FIG. 15) is captured between the corner panel 220 and side wall 212. This holds the tissue insert 240 in position on the bottom panel 204. When the box 200 is erected as shown in FIG. 16, the corner panel 220 still holds the corner of the tissue insert 240, but also permits the tissue insert to be removed by a slight tug if the user wishes to reposition the tissue insert 240 in any way.

In manufacturing all of the foregoing box blanks with tissue inserts, it is necessary to hold the tissue insert on the bottom panel of the box blank while the various operations of folding and gluing the side walls and corner panels are performed. It has been found advantageous to spray the tissue with water just prior to placing it on the bottom panel. The dampened tissue adheres to the bottom panel during the manufacturing processes, and then dries so that the tissue is not permanently adhered to the box and may be removed or manipulated, as desired. This provides an advantage over gluing the tissue to the bottom panel and, particularly when the water is applied in a fine spray or mist, does not denigrate the quality of the tissue.

Accordingly, there have been described boxes with tissue inserts that are easy to manufacture, and are convenient to use. The foregoing description of the preferred embodiments is intended to be illustrative, and it will be appreciated that various changes may be made without departing from the spirit and scope of the invention, which is limited only by the following claims.

We claim:

1. A tissue-lined box comprising:

A) a carton blank having a generally rectangular bottom panel with a width W, the carton blank having integral side walls and end walls connected with the bottom panel at creased fold lines;

B) four corner panels, one corner panel positioned at each respective corner of the generally rectangular bottom panel as an integral extension of at least one of the side wall and the end wall and connected to the other of the side wall and end wall to form a box;

C) fold lines extending from the four corners of the generally rectangular bottom panel and adapting the box for folding to a flat condition with the side walls and end walls positioned on the bottom panel and to an erected open position;

D) a folded tissue insert having at least one layer of tissue paper and folded to a substantially flat condition and having at least one folded side edge, the width T of the tissue insert taken from the folded side edge to an opposite side edge being greater to the width W of the bottom panel; and E) the folded tissue insert in its substantially flat folded condition positioned on the bottom panel with the tissue insert substantially covering the bottom panel and having at least one of the marginal portions adjacent one of the folded side edge and opposite side edge extending beyond the bottom panel and positioned on the adjacent side wall, the one of the first and second marginal portions of the tissue adjacent the side wall being folded at the crease line between the bottom panel and the side wall when the box is folded to its flat condition.

2. A tissue lined box as defined in claim 1 wherein the marginal portion of the tissue insert adjacent the other of its folded side edge and opposite side edge also extends across the folded crease line between the bottom panel and the adjacent side wall, the marginal portion adjacent the second side edge also folded when the box is in flattened condition.

3. A tissue-lined box as defined in claim 2 wherein the opposite side edge of the tissue insert is also a folded edge of the tissue insert.

4. A tissue-lined box as defined in claim 1 wherein the tissue insert is releasably captured against at least one side wall.

5. A tissue-lined box as defined in claim 1 wherein each of the corner flaps defines a friction foot at its distal free corner.

6. A tissue-lined box as defined in claim 5 wherein each corner flap is relieved adjacent its friction foot by a relief edge that diverges from the adjacent box portions as it extends toward the friction foot.

7. A tissue-lined box as defined in claim 1 wherein the side walls have side have side wall extensions that fold over to form side walls of two thicknesses, and wherein at least one of the folded over side wall extensions captures a marginal edge of the tissue insert.

8. A tissue-lined box as defined in claim 7 wherein both folded over side wall extensions respectively capture the first and second marginal side edges of the tissue insert.

9. A tissue-lined box as defined in claim 1 wherein the corner panels are integral extensions of the end walls, the fold lines respectively extend from the corners of the rectangular bottom panel diagonally across the end walls, the end walls are folded on the diagonal fold lines to position the corner panels overlying the rectangular bottom panel, and the side walls are folded over the corner panels and secured thereto to form the box.

10. A tissue-lined box as defined in claim 9 wherein the marginal portions of the tissue insert adjacent the first and second side edges thereof are captured between the corner panels and the side walls.

* * * * *